United States Patent [19]

MacFarlane

[11] Patent Number: 4,795,888

[45] Date of Patent: Jan. 3, 1989

[54] VARIABLE KEYSTROKE PRESSURE APPARATUS

[75] Inventor: Andrew R. MacFarlane, North Sydney, Australia

[73] Assignee: A & K MacFarlane Pty. Ltd., North Sydney, Australia

[21] Appl. No.: 73,351

[22] Filed: Jul. 13, 1987

Related U.S. Application Data

[63] Continuation of Ser. No. 856,292, Apr. 25, 1986, abandoned.

[30] Foreign Application Priority Data

Apr. 29, 1985 [AU] Australia ..... PH0346
Aug. 26, 1985 [AU] Australia ..... PH2129

[51] Int. Cl.[4] ..... G06C 7/02; B41J 5/00; B41J 29/00

[52] U.S. Cl. ..... 235/145 R; 400/473; 400/480; 400/679; 400/719

[58] Field of Search ..... 200/5 A, 5 E, 83 B, 200/83 T; 235/145; 400/472, 480, 491, 496, 686, 719, 679, 690, 715

[56] References Cited

U.S. PATENT DOCUMENTS

| | | | |
|---|---|---|---|
| 2,800,034 | 7/1957 | Seeger | 200/5 R X |
| 3,268,673 | 8/1966 | Bilek | 200/5 E |
| 3,521,014 | 7/1970 | Bonanno et al. | 200/83 T |
| 3,535,479 | 10/1970 | Smyers, Jr. et al. | 200/83 T |
| 3,599,525 | 8/1971 | Klann | 200/83 B X |
| 3,603,983 | 9/1971 | Mitchell | 200/81.4 X |
| 4,054,944 | 10/1977 | Lau | 200/5 E X |
| 4,074,089 | 2/1978 | Mitsugi et al. | 200/5 E |
| 4,109,118 | 8/1978 | Kley | 200/5 E |

FOREIGN PATENT DOCUMENTS

| | | | |
|---|---|---|---|
| 922534 | 11/1956 | Fed. Rep. of Germany | 200/5 E |

OTHER PUBLICATIONS

IBM Technical Disclosure Bulletin; Easton, R. C.; "Hydraulically Controlled Keyboard Interlock Mechanism", vol. 14, No. 8, Jan. 1972, p. 2540.

*Primary Examiner*—J. R. Scott
*Attorney, Agent, or Firm*—Ladas & Parry

[57] ABSTRACT

A keyboard which is capable of varying the pressure required for the keystroke is provided and comprises an inflatable arrangement being a variable pressure bladder which fits over the keyboard between the base plate and the keys. The operator may vary the pressure delivered to the system as desired and may also preset a cycle of time intervals with pressure "on" and pressure "off". Alternatively, the pressure supply may be linked to a number of keyboards and a programmed variable pressure cycle will be delivered to all the keyboards.

8 Claims, 4 Drawing Sheets

VARIABLE KEYSTROKE PRESSURE APPARATUS

This is a continuation of application Ser. No. 856,292, filed on Apr. 25, 1986, now abandoned.

BACKGROUND OF THE INVENTION

This invention relates to keyboards such as for word processing terminals, and in particular to a means to vary the pressure required to depress the keys.

Keyboard operators are increasingly becoming susceptible to tenosynovitis and repetitive strain injuries. This condition is a result of a situation where the muscles of the forearm become over-worked at the same pressure for long intervals, causing muscle fatigue, mylin sheath irritation and blood stasis. Operators of all types of keyboards even telephone switchboards, are exposed to such a situation.

Apart from the overuse aspect there is also the stress problem caused by the continual impact to the fingers at the end of each keystroke as the key finds its stop position.

Lost time is experienced as operators need to have regular rest periods during typing, to relieve the muscle fatigue.

SUMMARY

It is an object of the present invention to ameliorate the above-mentioned disadvantages.

It has been found that by varying the keystroke pressure required by the operator there is a varying contraction of the forearm muscles, hence reducing blood stasis and muscle fatigue. This is turn will reduce the need for rest periods.

In accordance with one broad aspect of the present invention there is provided a keyboard wherein variable pressure means are provided to vary the pressure necessary to successfully depress a key.

In a further broad form there is provided a variable keystroke pressure apparatus comprising an inflatable means adapted to be disposed between at least some of the keys of a keyboard and the keyboard base in such a manner that the pressure inside said inflatable means can be varied to vary the pressure necessary to successfully depress a key.

Apart from providing exercise to the fingers the invention also provides a cushioning effect at the end of each keystroke to prevent the impact effect on the fingers.

BRIEF DESCRIPTION OF THE DRAWING

One embodiment of the present invention will now be described, by way of example only, with reference to the accompanying drawings, in which.

DESCRIPTION OF THE PREFERRED EMBODIMENT

Figure 1:
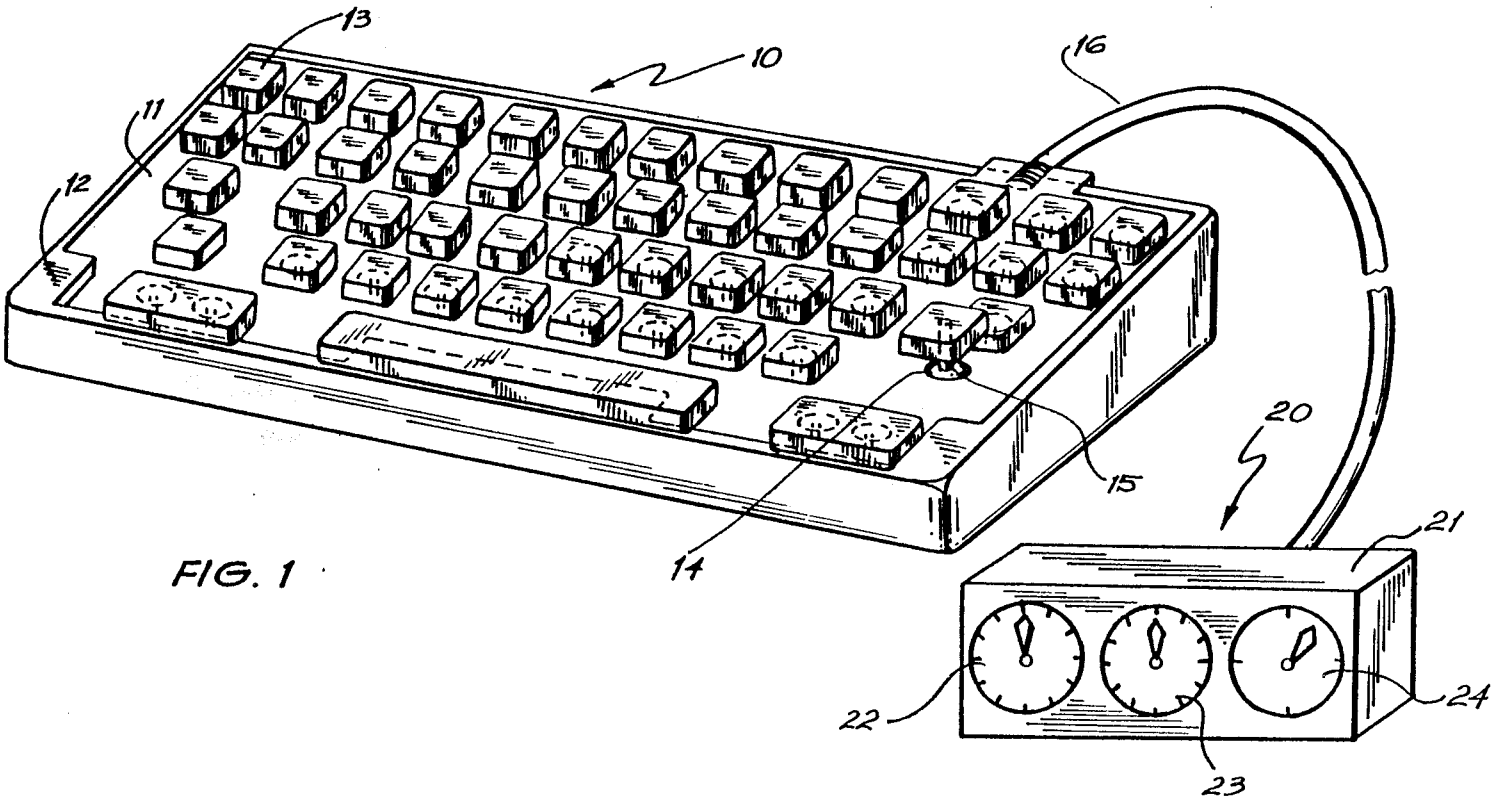
FIG. 1 is a perspective view of the inflatable means fitted to a keyboard.
Figure 2:
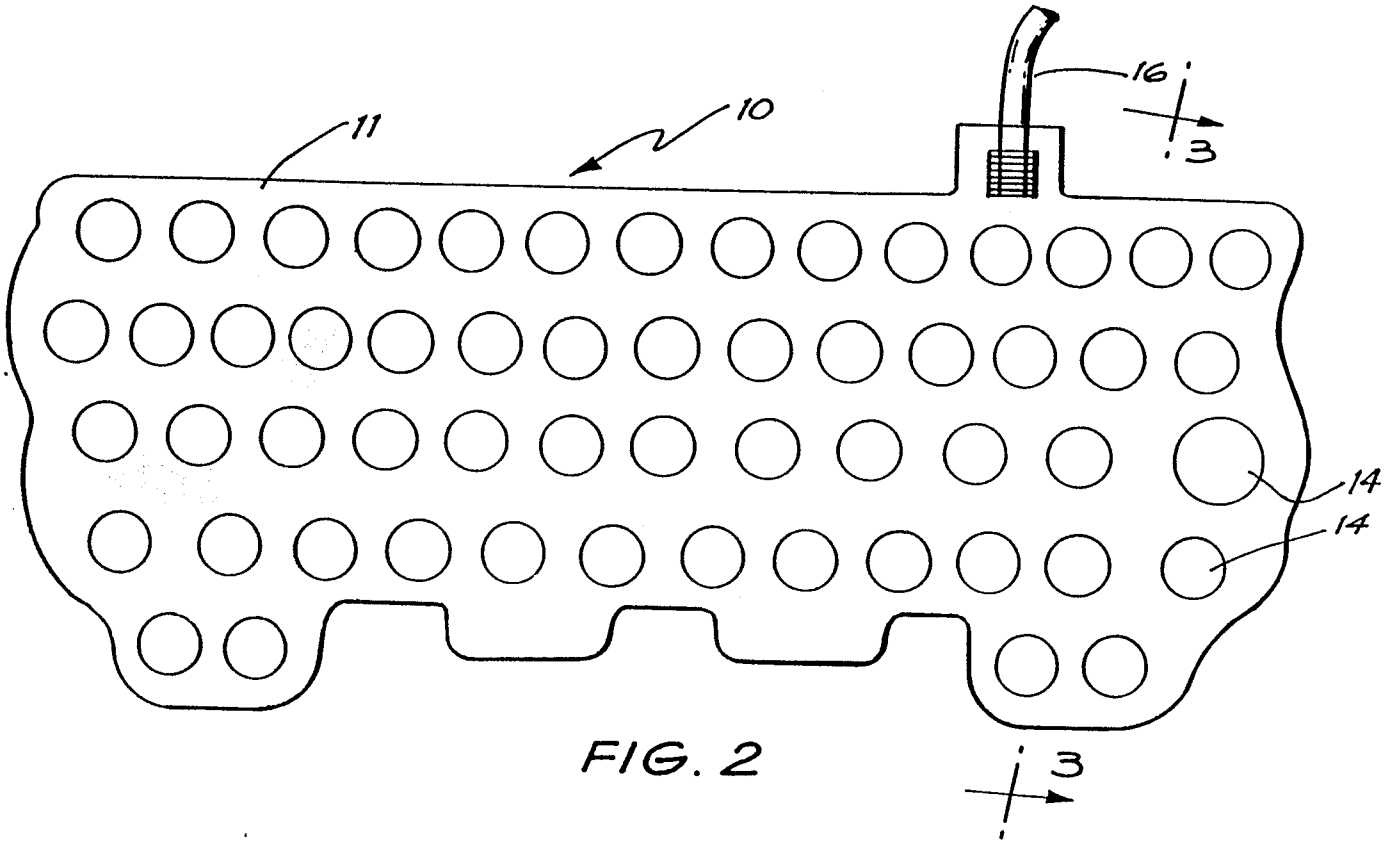
FIG. 2 is a plan view of the inflatable means of FIG. 1.

In FIG. 1 the inflatable means 10 comprises a variable pressure bladder 11 which is designed to fit between the base plate 12 and keys 13 of a keyboard. The design of the bladder 11 will vary for different keyboard layouts but in general it has a series of apertures 14 which once the keys 13 are removed allows the bladder 11 to be placed over the key shafts 15 through the apertures 14 and rest on the base plate 12. The edges of the apertures 14 are sealed. The keys 13 and then replaced on their relevant shafts 15. The bladder 11 thus surrounds the base of each key shaft 15 while still allowing the key 13 full range of movement in order to register its depression. A tube 16 is fitted to the bladder 11 at one end and to a variable pressure system at the other end. The pressure within the bladder 11 may be held constant for a particular user. Alternately the pressure may be varied according to a predetermined cycle. By cyclically varying the pressure over say 30 minutes or one hour, the user gets varying exercise whilst keystroking which will adequately provide the exercise needed to substantially reduce or avoid the need for exercise breaks.

A simple form of the variable pressure system 20 comprises an air pump mounted within housing 21.

The pump outlet is connected to the tube 16.

The operator may vary the pressure and the time intervals within the cycle, by setting the dials 22, 23 and 24 which control the pump, for a cycle with the pressure "on" and the pressure "off" at predetermined intervals.

The dial 22 can be set for a certain time period with pressure "on" whilst the dial 23 can be set for time period with the pressure "off". In this way the timers switch the air pump mounted within the housing 21 either "on" or "off" for the predetermined cycle periods. When the pump is turned on it supplies air to the bladder at the desired pressure which is controlled by the third dial 24. In this way the pressure may be selected to be "on" for say ten minutes and then "off" for say five minutes.

The system can operate between pressures of 0 kPa and 10 kPa (kilopascals), however, the normal working range is more likely to be in the area of 0.5–6 kPa. The force which must be exerted to contend with pressures above say 8 kPa is unlikely to allow higher pressures to be used in practice. The maximum pressure used simple relates to whatever is a reasonable maximum force required to depress a key without making it unduly heavy for the operator.

By retaining a low pressure in the bladder in the "off" cycle a cushioning effect is maintained.

Figure 3:
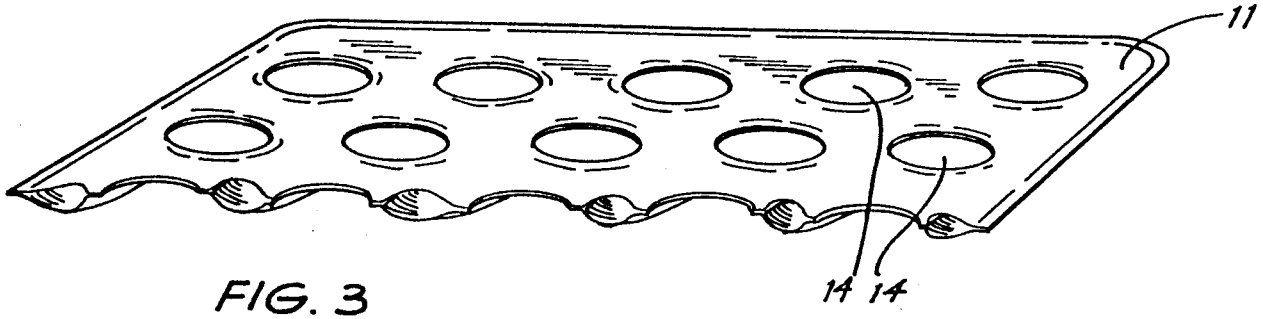
FIG. 3 is a view of Section 3—3 of FIG. 2 showing the bladder in a partially inflated disposition.
Figure 4:
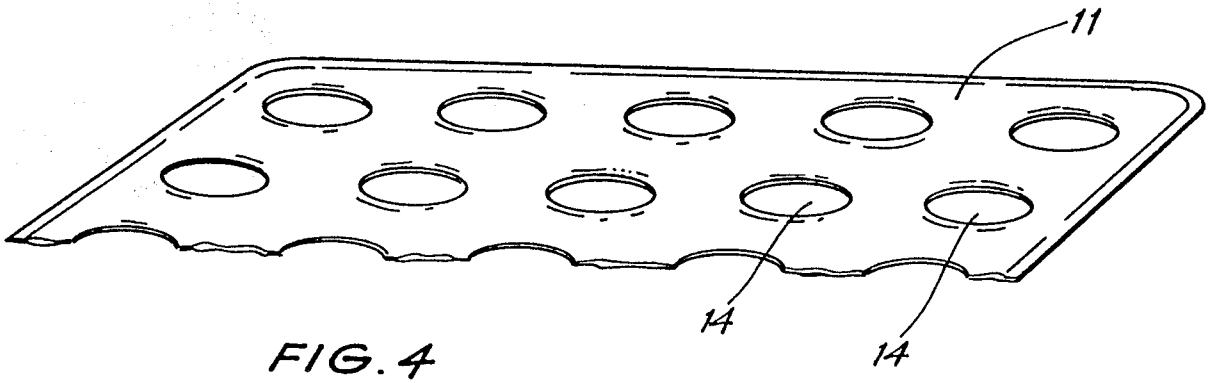
FIG. 4 is a similar view of FIG. 3 but showing the bladder in an evacuated disposition.

The construction of the bladder 11 does not require any exotic methods of materials. In a simple form it can be made from two sheets of durable, resilient plastics material welded together around the perimeter and apertures 14 as shown in FIGS. 3 and 4. In a slightly more sophisticated form the two sheets may be separated by a vertical wall at the welds.

Figure 5:
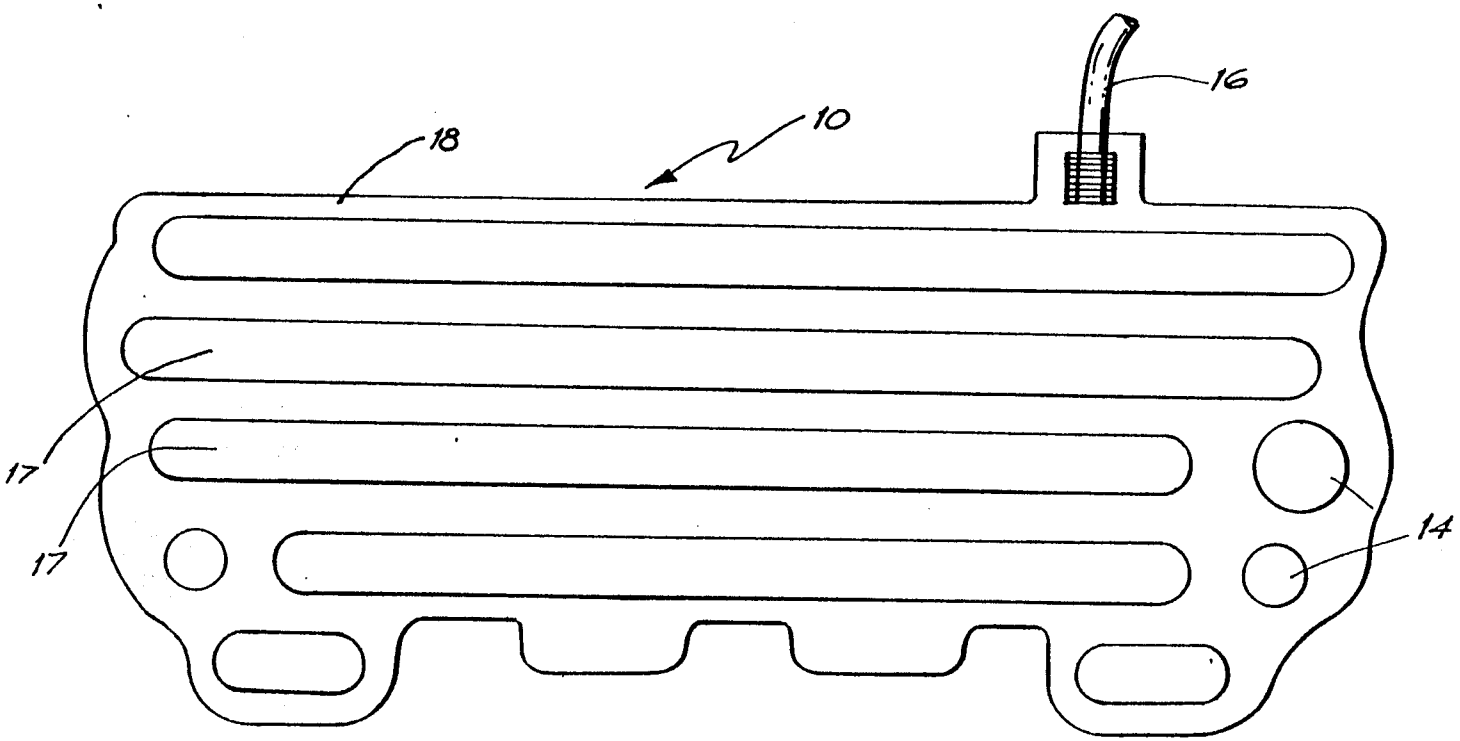
FIG. 5 is a plan view of an alternative inflatable means to that shown in FIG. 2.

FIG. 5 shows a plan view of a variation on the bladder 11 shown in the preceding figures and description, in that instead of providing an individual aperture 14 for each key shaft 15, a series of slotted apertures 17 are provided. The slotted apertures 17 allow for sufficient support of the keys by the bladder 18 and also allow for one bladder 18 to accommodate a range of keyboard layouts.

In large systems a series of keyboards can be linked to a programmed air pump to provide the pressure variations necessary, to a large number of users.

An alternate form of providing a pressure variable keystroke apparatus would be the use of an electromagnetic field between the base plate and the key, instead of the inflatable bag means. However, this would result in an increase in the electrical interference which is an undesirable and detrimental element in any computer-/electrical system.

The foregoing describes only one embodiment of the present invention and modifications, of use of those skilled in the art, can be made thereto without departing from the scope of the present invention.

What we claim is:

1. A method for safeguarding against the incidence of keyboard fatigue, and specifically repetitive strain injury, to operators of keyboards of the kind having a base, and a plurality of keys manually depressible with respect to said base;

comprising positioning a flexible fluid-containing bag between said base and said keys whereby depression of any one of said keys is resisted by the pressure of said fluid in said bag, and varying automatically over a period of time the pressure of said fluid in said bag to effect changes in the resistance provided to key operation.

2. A method according to claim 1, wherein said pressure of said fluid is varied automatically according to a predetermined cycle.

3. A method according to claim 2, wherein said cycle includes a selected fluid pressure applied and disconnected over selected time intervals.

4. A method according to claim 1, wherein said variation in said pressure of said fluid is determined by selection of a level of pressure and of a time period with said pressure "ON" and a time period with said pressure "OFF".

5. A method according to claim 1, wherein said pressure variation is within the range of 0.5–6 kPa.

6. In a keyboard including a base, key shafts upstanding from said base, and keys on said shafts manually depressible with respect to said base, the improvement of automatic variation of resistance to key depression during operation comprising a flexible fluid containing bag positioned between said base and said keys and having sealed apertures through which said key shafts extend, fluid pump means connected to said bag, and means on said pump means for selective adjustment of the pressure of said fluid and of the time intervals during which said pressure is "ON" and "OFF" to effect automatic variation over a period of time of the pressure of fluid in said bag to cause changes in said resistance to key depression.

7. A keyboard as claimed in claim 6, wherein said pump means is programmable to operate in a cyclic manner.

8. A keyboard as claimed in claim 6, wherein said fluid is air, and said adjustment of fluid pressure is from 0.5–6 kPa in increments.

* * * * *